United States Patent [19]

Croley

[11] 4,342,405

[45] * Aug. 3, 1982

[54] RECTANGULAR FIBERBOARD CONTAINER FOR BULK MATERIAL WITH FUNNEL-LIKE DISPENSING BOTTOM

[75] Inventor: Thomas E. Croley, Worthington, Ohio

[73] Assignee: Willamette Industries, Inc., Portland, Oreg.

[ * ] Notice: The portion of the term of this patent subsequent to Dec. 23, 1997, has been disclaimed.

[21] Appl. No.: 191,140

[22] Filed: Sep. 26, 1980

Related U.S. Application Data

[63] Continuation-in-part of Ser. No. 81,767, Oct. 4, 1979, Pat. No. 4,240,565.

[51] Int. Cl.[3] ..... B65D 35/56

[52] U.S. Cl. ..... 222/105; 222/183; 222/460; 222/564

[58] Field of Search ..... 222/460, 461, 462, 564, 222/105, 183; 229/17 B, 23, 23 BT

[56] References Cited

U.S. PATENT DOCUMENTS

| | | | |
|---|---|---|---|
| 3,172,570 | 3/1965 | Lipschutz | 222/105 |
| 3,563,448 | 2/1971 | Croley | 229/23 |
| 4,042,164 | 8/1977 | Croley | 229/23 BT |
| 4,120,420 | 10/1978 | Dirksing | 222/460 X |
| 4,240,565 | 12/1980 | Croley | 222/105 |

*Primary Examiner*—Allen N. Knowles
*Attorney, Agent, or Firm*—William V. Miller

[57] ABSTRACT

A container body of fiberboard or the like of rectangular form with a funnel-like dispensing bottom composed of a plurality of segmental insert sections, each of which is wedge shaped in both horizontal and vertical cross-sections to tightly wedge in place and direct material from the four upstanding sides of the container body to a central dispensing opening. To obtain adequate crush-resisting strength in the funnel-like bottom, a plurality of insert sections are disposed side-by-side along each of the upstanding sides of the container body.

12 Claims, 14 Drawing Figures

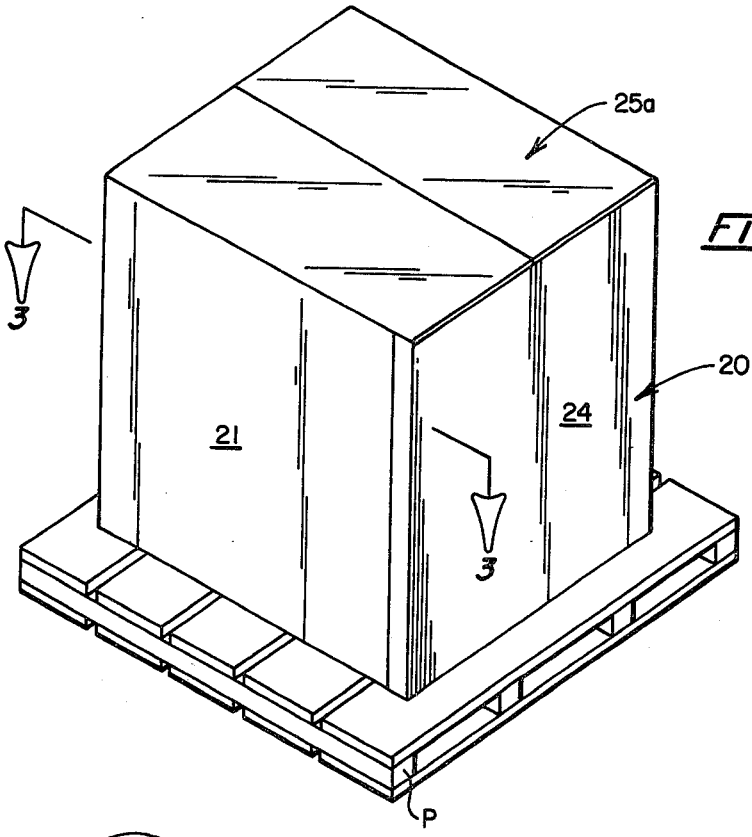
FIG. 1
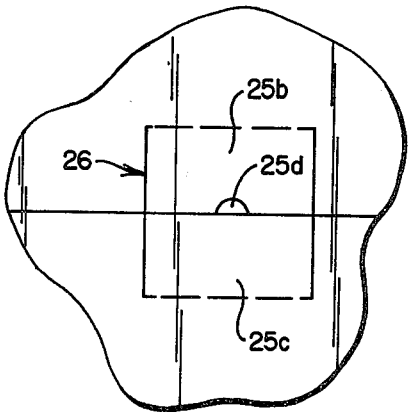
FIG. 4
FIG. 2
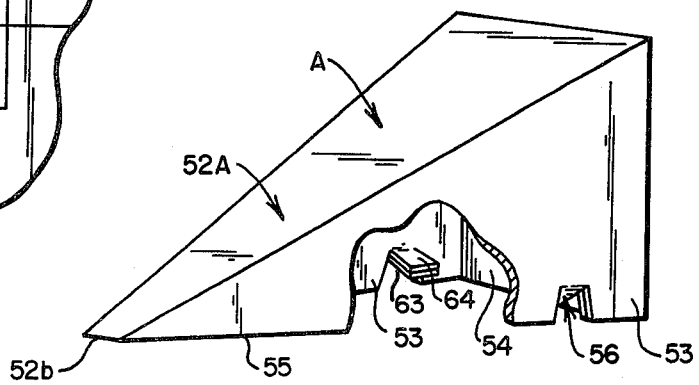

FIG. 6
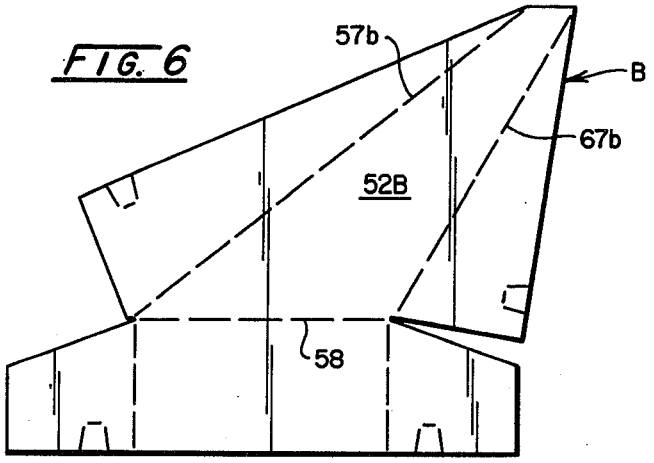
FIG. 7
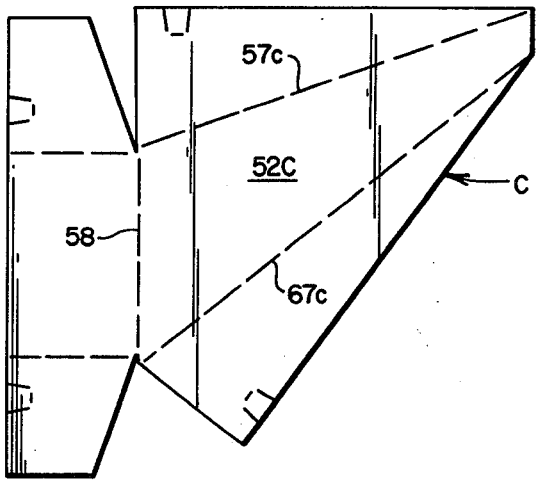
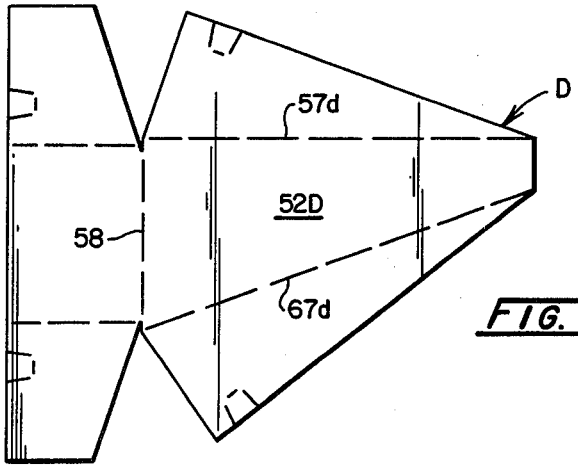
FIG. 8

RECTANGULAR FIBERBOARD CONTAINER FOR BULK MATERIAL WITH FUNNEL-LIKE DISPENSING BOTTOM

BACKGROUND AND BRIEF DESCRIPTION OF THE INVENTION

This application is a continuation-in-part of copending application Ser. No. 081,767, filed Oct. 4, 1979, now U.S. Pat. No. 4,240,565; issued Dec. 23, 1980.

In that copending application there is disclosed a drum-like container of fiberboard or similar material supplied in flat knocked-down form and adapted to be set up to serve as a shipping and dispensing container for bulk material. It is provided with a funnel-like dispensing bottom made up of fiberboard segmental wedge-shaped bottom insert sections which are supplied in flat knocked-down form and are adapted to be first set up and then positioned on the bottom of the container in a funnel-like arrangement with a central dispensing opening. Because the container disclosed in that application is multi-sided, specifically sixteen sides, which are provided by upright vertical panels hinged together, it is possible to have a single segmental bottom insert section for each wall panel and still obtain sufficient crushing strength at the bottom to resist the heavy weight of the bulk material packed in this type of container.

However, the present invention is applicable to a container of rectangular horizontal cross-section and if only one bottom insert segmental section were provided for each of the four sides to provide the funnel-like dispensing bottom, adequate crush-resisting strength would not result for the bottom. Therefore, this invention provides a structure which consists of a plurality of separate segmental wedge-shaped bottom insert sections cooperating with each side wall panel. Each section includes an upper material-directing wall having a pair of depending wedge-shaped support walls, each with a wider end outwardly at its cooperating side wall panel and having a lower edge resting on a bottom support means of the container. Thus, the plurality of depending support walls along each side of the rectangular container gives adequate strength to resist crushing of the funnel-like bottom.

BRIEF DESCRIPTION OF THE DRAWINGS

The best mode contemplated in carrying out this invention is illustrated in the accompanying drawings in which:

FIG. 1 is a perspective view of an elongated rectangular container embodying this invention disposed on a pallet;

FIG. 2 is a perspective view of one of the wedge-shaped segmental bottom insert sections of this invention used in the container of FIG. 1;

FIG. 4 is a bottom view showing a displaceable opening-forming tab arrangement in the bottom of the container;

FIGS. 6 to 8 are plan views similar to FIG. 5 showing other blanks used in forming other bottom insert sections used in the funnel-like bottom according to this invention;

DETAILED DESCRIPTION OF THE DRAWINGS

Figure 3:
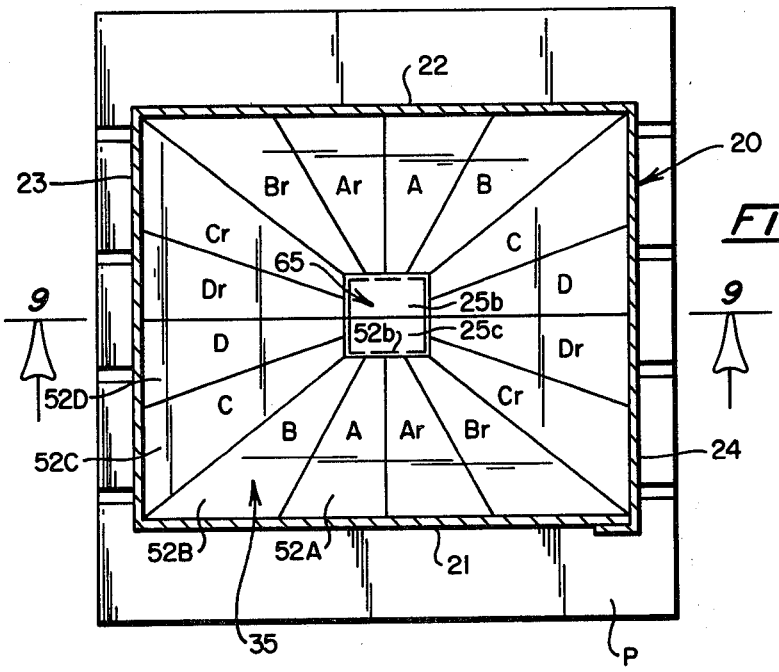
FIG. 3 is an enlarged horizontal sectional view taken along line 3—3 of FIG. 1.

With reference to the drawings and particularly to FIG. 1, there is shown generally a fiberboard container of parallelpiped form having a body 20 of elongated rectangular cross-section to which my invention can be applied. The specific structure of the container is not important to this invention and it can be formed from the usual flat cut, scored and slit blank and supplied in knocked-down form. When set up, it will have the usual pair of opposed elongated upstanding side walls 21 and 22 and end walls 23 and 24 which are of less width than the side walls formed from hinged panels of the blank. The usual bottom flap arrangement 25 may be provided, and a similar top flap arrangement 25*a* may also be provided consisting of flaps hinged to the respective side and end panels as usual. The structure so far described is a common rectangular box structure and is given only as an example, since the present invention is not limited to this particular structure as it only requires a container body of rectangular horizontal cross-section with bottom support means for the wedge-shaped bottom insert sections to be described. The bottom 25 may be secured to a pallet P (FIGS. 9 and 10) by fasteners F in the form of nails or staples passed through flaps of the bottom 25 into slats of the pallet.

Figure 9:
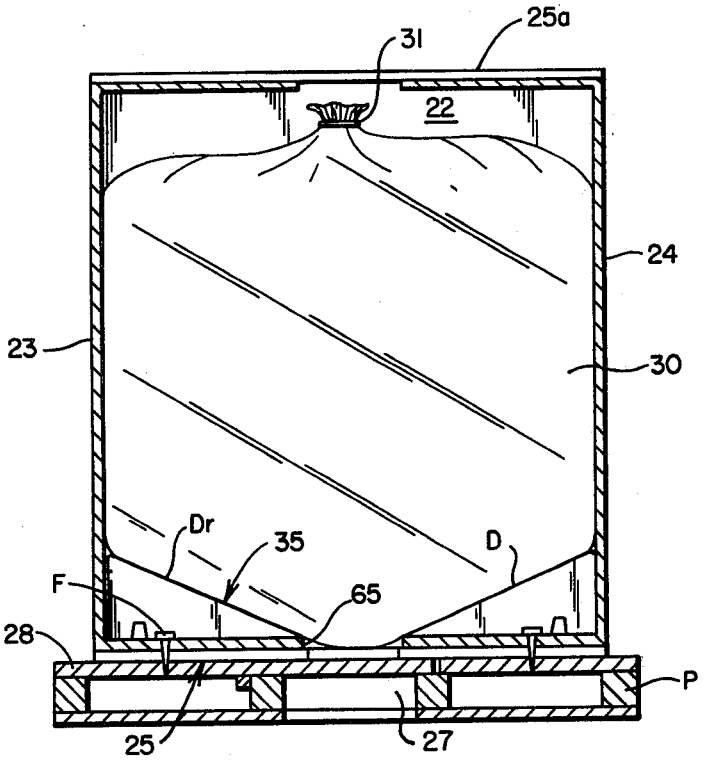
FIG. 9 is a vertical sectional view taken along line 9—9 of FIG. 3 showing the container filled and the bottom sealed.
Figure 10:
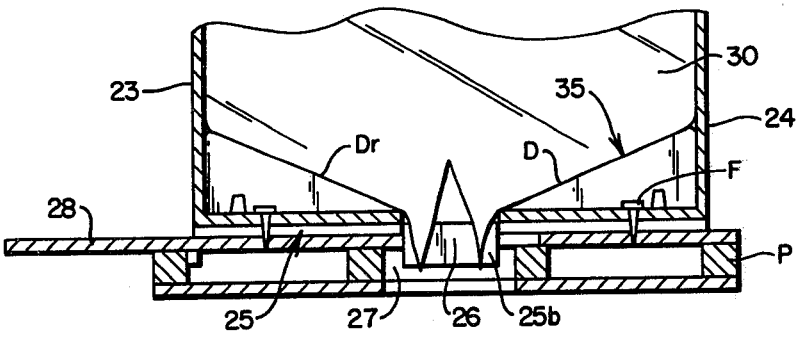
FIG. 10 is a similar but partial sectional view showing the bottom unsealed.
Figure 11:
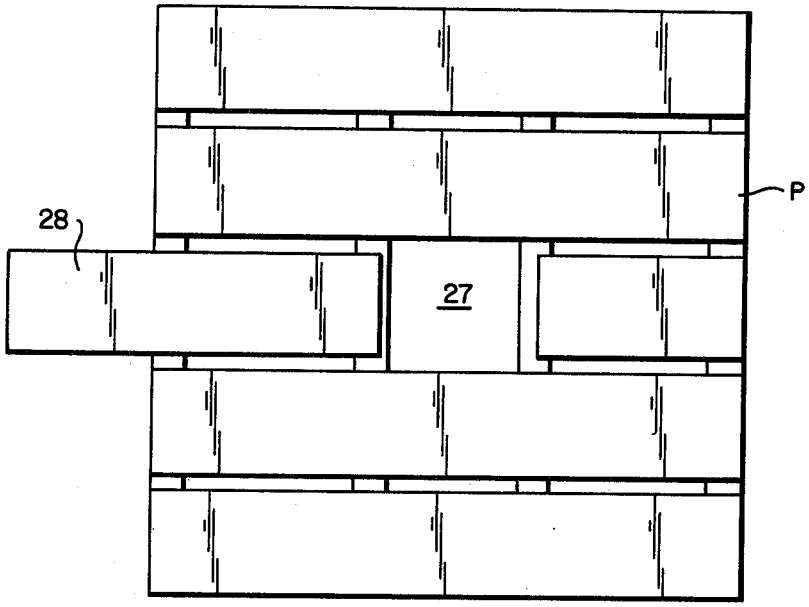
FIG. 11 is a plan view of a pallet which may be used as a support for the container.

In order to dispense material through the bottom 25 of the container, a central square opening 26 can be provided by means of a pair of meeting hinged tabs 25*b* and 25*c* formed in the adjacent edges of the longer flaps of the bottom closure 25 which will be outermost, by means of perforation and slits, as indicated, including a semicircular cut to provide a pull-out tab 25*d*. The hinged tabs 25*b* and 25*c* are normally in the plane of the flat bottom but they can be displaced downwardly to provide the central bottom opening 26. To cooperate with this opening 26, the pallet P is provided with a central opening 27, as shown in FIGS. 9, 10, and 11, which is normally covered by the slidable slat 28, as shown in FIG. 9. In closed inner position, the slat 28 will be beneath the downwardly-displaceable opening-forming tabs 25*b* and 25*c*.

If the container assembly is to receive certain materials, such as dry granular materials, liquids or semi-liquids, it may be desirable to provide a liner in the form of a bag 30 which will be closed at its bottom and open at its upper end. This bag, as will later appear, will rest in the funnel-like bottom of the container and will preferably be filled from the top while in that position, being held closed or sealed after filling by any suitable fastening means 31 at the top.

To ensure that all the contents of the container will flow therefrom through the central bottom opening 26 formed by displacing tabs 25*b* and 25*c*, there is provided, according to this invention, a false bottom of funnel-like form indicated generally by the numeral 35. This bottom is made up of individual wedge-shaped segmental insert sections which are set up from a flat blank and then inserted within and wedged together tightly in the container body 20 and rested on the flat bottom 25 around the opening-forming tabs 25*b* and 25*c*.

Each segmental insert section is made from a flat blank properly cut, slit and scored with little waste so that when it is set up it is substantially wedge-shaped both transversely, or in horizontal cross-section, as well as longitudinally, or in vertical cross-section. Although four different sections are needed to form the funnel-like bottom 35 for the elongated rectangular container body 20, all of them will have the general appearance and structure of that shown in FIG. 2 which is designated A. Thus, each section will include an inclined-plane, material directing wall, designated 52A in this Figure, supported in its inclined position by a pair of vertical support walls 53 and an outer vertical support wall 54. The vertical walls 53 converge towards each other at the inner end of the insert, but are separated at an edge 52*b* which is of an extent corresponding to one-fourth the width of the dispensing opening 26. Thus, wall 52A is substantially triangular or wedge-shaped in plan. The support wall 54 at the outer end of the insert is of rectangular form and of substantial height, so that the material-directing wall 52A will incline sharply. All the vertical walls have lower support edges 55 in a common horizontal plane. A locking arrangement is provided at 56 to hold the segmental structure together after it is set up.

Figure 5:
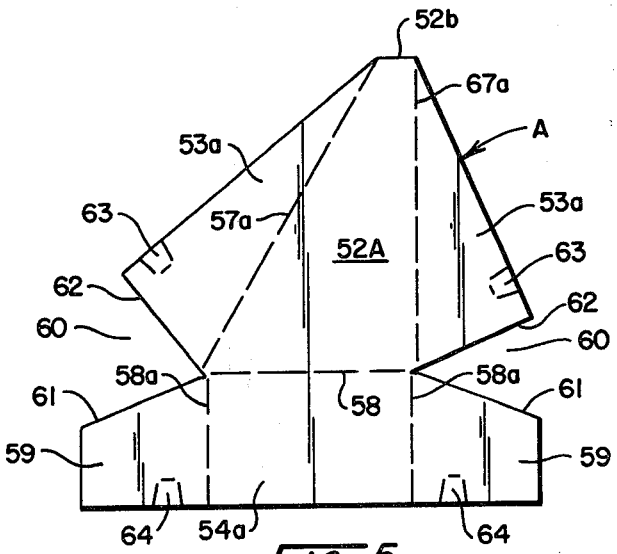
FIG. 5 is a plan view of a blank used in forming one of the bottom insert sections.

The other three insert sections are designated B, C and D, and FIGS. 5 to 8, inclusive, show the blanks of fiberboard cut, slit and scored, as indicated, to produce the respective sections A, B, C and D. The main difference in the sections is in the shape of the triangular material-directing upper wall which is designated 52A, 52B, 52C, and 52D in the respective FIGS. 5 to 8. As indicated in FIG. 5, which shows the blank for A, each of these walls is hinged at both of its side edges, at score lines indicated 57*a* and 67*a*, to a pair of the triangular vertical wall-forming panels 53*a*. At its wider end, the triangular material-directing panel is hinged at score line 58 to the end vertical wall-forming panel 54*a* of rectangular form which, in turn, is hinged at the score lines 58*a* to a pair of locking flaps 59. Large V-notches 60 are formed at opposed sides of the blank to provide the angular edges 61 on the panels 59 in proper diverging relationship to the edges 62 of the panels 53*a*. The locking means 56, previously mentioned, is formed by displaceable hinged locking tabs 63 formed in the outer edges of the respective panels 53*a*, adjacent edges 62, and similar tabs 64 formed in the outer straight edges of the respective panels 61, adjacent the hinge score lines 58*a*.

The blank is folded at score lines 57*a* and 67*a* from its flat condition of FIG. 5 so that the panels 53*a* are vertical. Then the locking flaps 59 are folded in the same direction, at score lines 58*a*, relative to the panels 54*a* and simultaneously, the panel 54*a* is folded, at score line 58, to move the flaps inwardly within and into overlapping relationship with the vertical panels 53*a*. As the wall panel 54*a* reaches vertical position, the locking tabs 64 of flaps 59 will align with the locking tabs 63 of the panels 53*a*. It will be noted from FIG. 2 that when each of the locking flaps 59 is fully inserted, its angular edge will lie beneath and in contact with the lower surface of the inclined wall 52*a* and that the straight edge of the flap will be lowermost and will align with the straight lower edge of the adjacent vertical wall 53. To secure these overlapping panels together, it is merely necessary to push inwardly to displace the overlapping tabs 63 and 64.

In the blank for insert section A shown in FIG. 5, one of the side hinge score lines 67*a* is at a right angle to the end hinge score line 58 whereas the other side hinge score line 57*a* is at an acute angle thereto, so that the wall 52A is of substantially the form of a right-triangle. In FIG. 6, the blank for forming insert section B has both hinge lines 57*b* and 67*b* angularly disposed relative to hinge line 58, one being at an acute angle and the other at an obtuse angle. It will be noted that wall 52B is slightly longer and wider at its hinge 58 than wall 52A. The blank shown in FIG. 7 for forming insert section C is almost like that of FIG. 6 except triangular wall 52C hinged at 57*c* and 67*c* is longer than the wall 52B and lines 57*c* and 67*c* are at different angles and its hinged end 58 is of less width. Hinges 57*c* and 67*c* are also at different angles. Also, the blank shown in FIG. 8, for forming the insert section D, is substantially like that of FIG. 5, except that the right-triangular wall 52D hinged at 57*d* and 67*d* is longer and narrower at its hinge 58 than the wall 52A.

With the bottom flaps of the bottom closure 25 in closed position, as shown in FIG. 9, the false funnel-like bottom 35 may be formed by inserting the segmental sections A, B, C and D in the sequence indicated in FIG. 3. First, each section used is set up from its blank to the condition shown in FIG. 2 so that the support walls 53 and 54 are in proper depending positions. Starting at the midpoint at one of the longer sides 21 of the container body 20 (FIG. 3), a section A is used first, and then sections B, C, and D are inserted successively clockwise to form the one quadrant of the false bottom. All of these sections have the walls 52A, 52B, 52C, and 52D of proper shape and length so that in each insert section the outer vertical wall 54 is in face contact with the inner surface of the side wall 21 or end wall 23 and its inner edge 52*b* is at the edge of opening-forming flap 25*c*. The lower edges of support walls 53 and 54 will rest on bottom 25. Walls 54 of sections A and B are of a combined width equal to one-half the length of box side wall 21 or 22 and walls 54 of sections C and D are of a combined width equal to box end wall 23 or 24. Continuing clockwise, the next quadrant is formed by insert sections Dr, Cr, Br and Ar which are the same as sections D, C, B and A, except that the panels 53*a* are folded about their respective hinge lines to depend from the respective triangular walls 52D, 52C, 52B, and 52A in the reverse direction. These sections are therefore designated Dr, Cr, Br, and Ar. The respective vertical walls 54 of these sections will be in face contact with end wall 23 and side wall 22 and their inner edges will be at the edge of opening-forming tab 25*b*. The lower edges of support walls 53 and 54 will rest on bottom 25. The next quadrant clockwise will be formed by successive insert sections A, B, C, D with the outer support walls 54 thereof beng at side wall 22 and end wall 24 and their inner ends being at tab 25*b*. The final quadrant will be formed by successive sections Dr, Cr, Br and Ar with the outer support walls 54 thereof being at end wall 24 and side wall 21 and their inner ends being at tab 25*c*. Thus, each quadrant of the funnel-like bottom is formed by four insert sections, one shorter right-triangular section having its longer straight side at the minor axis of the rectangle and the other longer right-triangular section having its longer straight side at the major axis of the rectangle, with two intermediate triangular insert sections, one having its outer support wall at the shorter end wall of the container body and the other having its outer support wall at the longer side wall of the container body. Also, the sections at diagonally-opposed quadrants are the same but at alternating quadrants, the depending support walls are reversed relative to the plane of the triangular material-directing wall. It will be noted that four insert sections are provided along each vertical wall 21, 22, 23, and 24.

The segmental sections inserted as indicated in FIG. 3 being wedge shaped horizontally will tightly engage each other laterally when the last section is inserted. With their lower edges 55 resting on the bottom 25 and their outer walls 54 in face contact with the respective vertical walls 21, 22, 23, and 24 of the container body 20, their inner edges **52*b* will form the central square opening 65 over the downwardly-displaceable tabs 25*b* and 25*c*, as shown in FIG. 3. The various material-directing triangular walls 52A, 52B, 52C, and 52D will be supported in inclined position so that they will direct the material toward the opening 65, as indicated in FIG. 9. The triangular wall 52A will have its straight hinge edge 57*a* of a length equal to one-half the width of the container body 20*a* less one-half the width of the opening 65. The right triangular wall 52D will have its straight hinge edge 57*d* of a length equal to one-half of the length of the container body less one-half the length of the opening 65**.

Thus, the false bottom 35 so formed is a funnel-like bottom which will direct the contents of the container to the central opening 65. It may be desirable to use a bag 30 for holding the contents and have it rest on the funnel-like bottom 35. Then to dispense the contents, the tabs **25*b* and 25*c* will be pulled downwardly by means of pull tab 25*d*, after the slat 28 of the pallet P is pulled out of the way. The opening 65 will now be exposed and the bag 30 may be ruptured to permit discharge of its contents as indicated in FIG. 10**.

Figure 12:
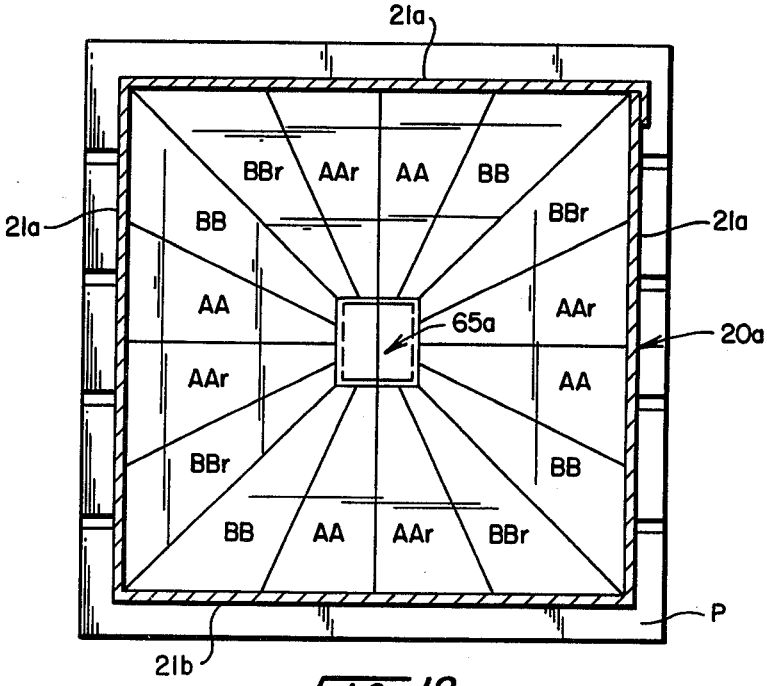
FIG. 12 is a horizontal sectional view similar to FIG. 3, but showing the invention applied to a rectangular container of square horizontal cross-section.

When, as indicated in FIG. 12, the container body **20*a* has a horizontal cross-section of square form with all vertical sides 21*a* of equal width, only two sections AA and BB will be necessary, one of these sections being a right-triangular section like section A and the other being like section B, previously described, but havng the upper inclined material-directing triangular walls thereof of equal length and width at hinge lines 58. At each quadrant, there will be four insert sections, which will be designated AA, BB, BBr, and AAr, the suffix r designating that the support panels 53*a* and 54*a* are reversed in that section relative to the plane of the triangular material-directing wall. Thus, in this square body 20*a*, each quadrant is formed by four insert sections consisting of two right-triangular sections, with their straight longer sides along the axes of the square, and with their outer support walls in face contact with adjacent vertical sides 21*a* of the container body 20*a*, plus two intermediate triangular insert sections which are of the same size but have their depending support walls extending in reverse directions relative to the plane of the inclined material-directing wall. Also, it will be noted that, with this arrangement, there are four insert sections along each side 21*a* of the square container body 20*a***. All quadrants will consist of the same sections arranged in the same sequence.

Figure 13:
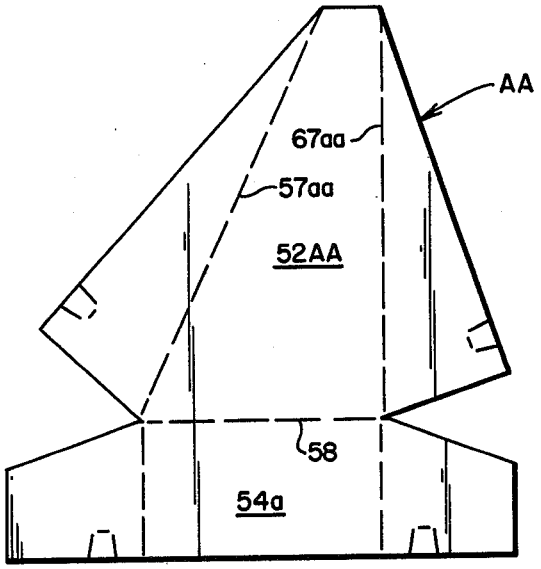
FIGS. 13 and 14 are plan views of two blanks used in forming the insert sections for the bottom of the square container of FIG. 12.
Figure 14:
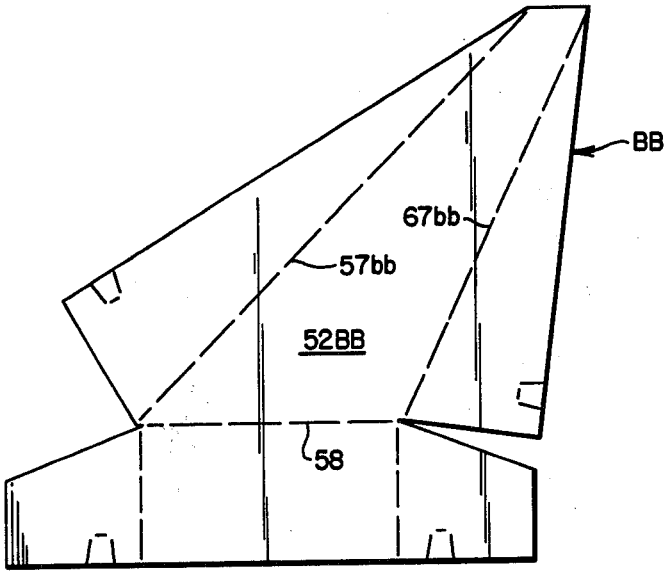

The blank for insert section AA is shown in FIG. 13 and that for section BB is shown in FIG. 14. The blank for section AA includes the material-directing wall 52AA which is of right-triangular form and is hinged at both of its side edges, at score lines **57*aa* and 67*aa*, to a pair of the triangular support wall-forming panels. At its wider end, the triangular material-directing panel 52AA is hinged at score line 58 to the end vertical wall forming panel 54*a* of rectangular form. The length of the straight hinge line 57*aa* will be one-half the width of the container body 20*a* less one-half the width of the central square opening 65*a***.

The blank for intermediate insert section BB is similar to that for section B shown in FIG. 6 and includes the triangular material-directing wall 52BB, hinged at score lines **57*bb*, and 67*bb* which are at acute and obtuse angles, respectively, relative to the hinge line 58**.

Thus, insert sections AA and BB can be produced from the respective blanks of FIGS. 13 and 14 by bending the support wall panels about the hinge score lines so that the support walls depend from the plane of the triangular material-directing wall in one direction. Insert sections AAr and BBr can be produced by bending the support wall panels so that they depend from the plane of the material-directing wall in the opposite direction.

Thus, in each of the examples given, namely a container of elongated rectangular horizontal cross-section and one of square horizontal cross-section, each quadrant thereof is formed of a plurality of separate low cost segmental insert sections which are wedge-shaped in horizontal cross-section so that they will wedge tightly together, when inserted in the rectangular body of the container, and are wedge-shaped in vertical cross-section so as to provide the inwardly and downwardly inclined upper material-directing walls. In each example, there is a plurality of depending support-walls which gives the funnel-like bottom strength to resist crushing. In each example shown, there are four insert sections in each quadrant of the bottom. Two of the sections have upper material-directing walls in the form of right triangles and are reversed relative to each other so that their long straight sides are disposed along the respective axes of the rectangle. In the case of the square, these triangular sides will be equal but in the case of the elongated rectangle, the elongated straight side of one of the triangles will be shorter than that of the other.

It will be apparent from the above that this invention provides a bottom structure for a rectangular horizontal cross-section container of the type indicated which will ensure the effective discharge of all of the container contents. The bottom structure is formed of separate, low-cost wedge-shaped segmental insert sections which are provided in flat-knocked-down condition but can be readily set up quickly and inserted within the container body to provide a funnel-like material-directing and dispensing arrangement.

Having thus described this invention what is claimed is:

1. A container assembly comprising a tubular body of fiberboard or the like of rectangular cross-section with a bottom structure at its lower end and with four side-wall forming panels extending upwardly at the periphery thereof; said bottom structure including support means secured to said side-wall panels and a plurality of separate segmental insert sections forming a funnel-like dispensing bottom with a central dispensing opening, each of said separate insert sections comprising an upper material-directing wall having a pair of depending wedge-shaped support walls at its sides, each material-directing wall having a wider end outwardly at one of said side-wall panels and extending inwardly to a point spaced from the center of the bottom structure at the dispensing opening, said support walls having lower edges supported by said bottom support means of the bottom to support said material-directing wall so that it inclines downwardly towards said dispensing opening, said material-directing wall being of substantially triangular form with a wide end outwardly at the adjacent side-wall panel and a narrow end inwardly at the dispensing opening so that the insert is substantially wedge-shaped both vertically and horizontally; a plurality of said segmental insert sections being wedged side-by-side in cooperation with each of said side-wall panels and resting on said bottom support means so as to direct the material contained in the container body inwardly and downwardly from said side-wall panel to said dispensing opening.

2. A container assembly according to claim 1 in which each quadrant of the funnel-like dispensing bottom is formed of a plurality of the segmental insert sections and consists of two sections having their upper material-directing walls of right-triangular form in reversed relationship with one of their straight sides disposed along the respective axes of the rectangular container body and with their other straight sides at their wide outer ends disposed along respective adjoining side-wall panels, and a plurality of intermediate sections with the wide ends of the material-directing triangular upper walls thereof disposed along respective adjoining side-wall panels.

3. A container assembly according to claim 2 in which each quadrant of the funnel-like bottom consists of four segmental insert sections, two being said sections with said right triangular material-directing walls and two being intermediate sections that have upper triangular material-directing walls that are fitted between said sections having right-triangular walls.

4. A container assembly according to claim 3 in which the container body is of elongated rectangular form with a pair of opposed elongated side-wall panels and a pair of opposed shorter side-wall panels, said two sections with the reversed right-triangular material-directing walls in each quadrant being of unequal length so that the straight side of one is longer than the straight side of the other, the longer straight side being disposed at the major axis of the elongated rectangular container body with its wide outer end disposed at a shorter side-wall panel and the shorter straight side being disposed at the minor axis of the container body with its wide outer end disposed at an elongated side-wall panel.

5. A container assembly according to claim 3 in which the container body is of square form, the reversed right-triangular material-directing walls in each quadrant being of equal length and the straight sides thereof being disposed at the respective axes thereof with their wider outer ends disposed at the respective side-wall panels.

6. A container assembly according to claim 3 in which each segmental insert section also has an outer support wall depending from the wide outer end of the material-directing wall thereof with a lower edge supported by the support means of the bottom and with said outer support wall being in flat contact with the respective side-wall panel.

7. A container assembly according to claim 6 in which each triangular section has a blunt inner end to produce the dispensing opening, each triangular-material-directing wall of the two reversed right-triangular sections being of a length equal to one-half the length of its adjacent axis minus one-half the extent of said opening.

8. A container assembly according to claim 7 in which each of the sections is formed from a blank which has the support walls hinged to the sides and ends of the triangular material-directing wall and which is set up to produce the wedge-shaped segmental sections.

9. A container assembly according to claim 8 in which the depending outer support wall has locking flap members hinged to each vertical edge thereof extending into overlapping relationship with the inner surfaces of the corresponding depending wedge-shaped side support wall members, and aligning inwardly displaceable tabs in the overlapping locking flaps and side support wall members for locking them together.

10. A container assembly according to claim 3 in which the bottom-support means is in the form of horizontally-disposed closure flaps hinged to the side-wall panels and upon which the support walls rest, said flaps having downwardly displaceable portions below the said dispensing opening of said funnel-like bottom to form a communicating dispensing opening in the closure flaps.

11. A container assembly according to claim 10 in which a flexible bag, adapted to be filled with material to be dispensed, is provided within said container body on said funnel-like bottom, said bag having a bottom which can be ruptured through said dispensing opening in the closure flaps.

12. A container assembly according to claim 11 in which a pallet is provided on which said closure bottom rests, said pallet having a support part normally supporting said displaceable flap portions but movable away from that supporting relationship.

* * * * *